US011373520B2

(12) United States Patent
Tu et al.

(10) Patent No.: US 11,373,520 B2
(45) Date of Patent: Jun. 28, 2022

(54) METHOD AND DEVICE FOR SENSING TRAFFIC ENVIRONMENT

(71) Applicant: Industrial Technology Research Institute, Hsinchu (TW)

(72) Inventors: Ming-Ta Tu, New Taipei (TW); Ping-Ta Tsai, Kaohsiung (TW); Chung-Hsien Yang, Taipei (TW); An-Kai Jeng, Hsinchu (TW)

(73) Assignee: INDUSTRIAL TECHNOLOGY RESEARCH INSTITUTE, Hsinchu (TW)

( * ) Notice: Subject to any disclaimer, the term of this patent is extended or adjusted under 35 U.S.C. 154(b) by 251 days.

(21) Appl. No.: 16/521,473

(22) Filed: Jul. 24, 2019

(65) Prior Publication Data

US 2020/0160692 A1 May 21, 2020

Related U.S. Application Data

(60) Provisional application No. 62/770,369, filed on Nov. 21, 2018.

(30) Foreign Application Priority Data

May 15, 2019 (TW) ..... 108116665

(51) Int. Cl.
*G08G 1/01* (2006.01)

(52) U.S. Cl.
CPC ..... *G08G 1/0116* (2013.01); *G08G 1/0125* (2013.01)

(58) Field of Classification Search
CPC ..... G08G 1/0116; G08G 1/0125
See application file for complete search history.

(56) References Cited

U.S. PATENT DOCUMENTS 6,502,033 B1 12/2002 Phuyal
6,734,807 B2 5/2004 King
(Continued)

FOREIGN PATENT DOCUMENTS

CN 101286266 A 10/2008
CN 104376735 A 2/2015
(Continued)

OTHER PUBLICATIONS

Siva, K. Murali, et al. "A Smart/Efficient Method to Facilitate Highway Pedestrian Protection." Indian Journal of Science Technology, Sep. 2015, 4 pages, vol. 8, No. 21.
(Continued)

*Primary Examiner* — Tyler J Lee
*Assistant Examiner* — Yufeng Zhang

(57) ABSTRACT

A method for sensing a traffic environment for use in an electronic device is provided. The method includes: generating local object information by sensing an environment within a first sensing range of the electronic device, wherein the local object information at least includes first geographical distribution information of local objects within the first sensing range; receiving external object information transmitted by at least one node, wherein the external object information includes at least second geographical distribution information of external objects within a second sensing range of the node; and generating object integration information according to the local object information and the external object information.

18 Claims, 7 Drawing Sheets

(56) References Cited

U.S. PATENT DOCUMENTS

| | | | | |
|---|---|---|---|---|
| 7,447,592 | B2 | 11/2008 | Yopp et al. | |
| 8,315,756 | B2 | 11/2012 | Caveney | |
| 9,383,753 | B1 | 7/2016 | Templeton et al. | |
| 9,666,067 | B1 | 5/2017 | Nagpal et al. | |
| 9,834,216 | B2 | 12/2017 | Pawlicki et al. | |
| 2013/0079990 | A1 | 3/2013 | Fritsch et al. | |
| 2013/0289824 | A1 | 10/2013 | Mudalige et al. | |
| 2014/0307087 | A1 | 10/2014 | Evanitsky et al. | |
| 2014/0324312 | A1* | 10/2014 | Okuya | G08G 1/017 701/70 |
| 2016/0077166 | A1 | 3/2016 | Morozov et al. | |
| 2016/0300486 | A1* | 10/2016 | Liu | G08G 1/147 |
| 2017/0076599 | A1 | 3/2017 | Gupta et al. | |
| 2017/0092126 | A1 | 3/2017 | Oshida et al. | |
| 2017/0200374 | A1 | 7/2017 | Yanagihara et al. | |
| 2017/0238258 | A1* | 8/2017 | Ramalho de Oliveira | H04W 52/0261 455/574 |
| 2018/0218596 | A1 | 8/2018 | Castelli et al. | |
| 2019/0114921 | A1 | 4/2019 | Cazzoli | |
| 2019/0349389 | A1* | 11/2019 | Mizutani | H04L 12/28 |
| 2020/0111363 | A1* | 4/2020 | Maeda | G08G 1/0145 |
| 2020/0361493 | A1* | 11/2020 | Kawauchi | G06F 11/0751 |

FOREIGN PATENT DOCUMENTS

| | | | |
|---|---|---|---|
| CN | 108010360 | A | 5/2018 |
| CN | 108284838 | A | 7/2018 |
| JP | 2006195641 | A | 7/2006 |
| JP | 2011242846 | A | 12/2011 |
| TW | 201020140 | A1 | 6/2010 |
| TW | M403461 | | 5/2011 |
| TW | M485173 | | 9/2014 |
| TW | 201501979 | | 1/2015 |
| WO | WO 2017030492 | | 2/2017 |
| WO | WO2018105571 | A1 | 6/2018 |

OTHER PUBLICATIONS

Kotte, Jens, et al. "Concept of an enhanced V2X pedestrian collision avoidance system with a cost function-based pedestrian model," Traffic Injury Prevention, Apr. 2017, pp. S37-S43, Taylor & Francis, US.

Duncan, Gary, et al. "Multi-Modal Intelligent Traffic Signal System—Safer and More Efficient Intersections Through a Connected Vehicle Environment," IMSA Journal, 2014, 4 pages, IMSA, US.

Sun, Weihua et al. "Range-based Localization for Estimating Pedestrian Trajectory in Intersection with Roadside Anchors," Nov. 2009, 9 pages, IEEE, 2009.

Gavrila, D.M. et al. "Vision-Based Pedestrian Detection: the Protector System," IEEE Intelligent Vehicles Symposium, 2004, 6 pages, IEEE, US.

Ho, Ping-Fan et al., "WiSafe: Wi-Fi Pedestrian Collision Avoidance System". IEEE Transactions on Vehicular Technology, Jun. 2017, vol. 66, No. 6, IEEE, US.

Japan Patent Office, Office Action, Patent Application Serial No. 2019-196037, dated Dec. 22, 2020, Japan.

China Patent Office, Office Action, Patent Application Serial No. 201910716665.5, dated Sep. 27, 2020, China.

Taiwan Patent Office, Office Action, Patent Application Serial No. 108116665, dated May 25, 2020, Taiwan.

* cited by examiner

METHOD AND DEVICE FOR SENSING TRAFFIC ENVIRONMENT

CROSS REFERENCE TO RELATED APPLICATIONS

The present application claims priority from U.S. Provisional Application filed on Nov. 21, 2018 in the United States Patent and Trademark Office and assigned Ser. Nos. 62/770,369, and from Taiwan Patent Application No. 108116665, filed on May 15, 2019, the entirety of which are incorporated herein by reference.

TECHNICAL FIELD

The disclosure relates to a method and a device for sensing the traffic environment. Specifically, the present disclosure relates to a method and a device for sensing the traffic environment using Road Side Units (RSUs) to sense the traffic environment.

BACKGROUND

How to improve driving safety has always been of interest to the automobile industry. Many manufacturers have developed video cameras, radar imaging, LIDAR, and ultrasonic sensors to detect obstacles around a vehicle to inform drivers of road conditions.

However, a camera or radar mounted on a vehicle can generally only monitor an area in one or a few directions. When the vehicle is turning or in a blind spot, the camera cannot capture the locations of other vehicles, and radar monitoring cannot obtain information about the locations of vehicles in the unknown blind spots due to obstruction by obstacles. In this way, a blank area that the camera or radar cannot perceive may pose a threat to the safety of the vehicle or pose a risk of collision, thereby reducing the safety of said vehicle.

Thus, a method and a device for sensing the traffic environment are desired to minimize the disadvantages and improve driving safety.

SUMMARY

In an exemplary embodiment, a method for sensing the traffic environment is provided in the disclosure. The method comprises: generating local object information by sensing an environment within a first sensing range of the electronic device, wherein the local object information at least comprises first geographical distribution information of the local objects within the first sensing range; receiving external object information transmitted by at least one node, wherein the external object information comprises at least second geographical distribution information of external objects within a second sensing range of the node; and generating object integration information according to the local object information and the external object information.

In some exemplary embodiments, the local object information further comprises an identifier of the electronic device and first absolute position data of the electronic device, and the external object information further comprises an identifier of the node and second absolute position data of the node.

In some exemplary embodiments, the first comprises distribution information comprises relative position data of the local objects relative to the electronic device, and the second comprises distribution information comprises relative position data of the external objects relative to the node.

In some exemplary embodiments, the step of generating object integration information according to the local object information and the external object information comprises: obtaining absolute position data of the local objects and absolute position data of the external objects according to the first absolute position data, the second absolute position data, the first geographical distribution information and the second geographical distribution information; determining whether the absolute position data of the local objects are the same as the absolute position data of the external objects; and integrating the local object information and the external object information to generate object integration information when the absolute position data of the local objects are not the same as the absolute position data of the external object.

In some exemplary embodiments, the local object information further comprises a local time stamp, and the external object information further comprises an external time stamp.

In some exemplary embodiments, the step of generating object integration information according to the local object information and the external object information comprises: determining whether a difference between the local timestamp and the external timestamp is greater than an update period; and deleting the external object information when the difference is greater than the update period.

In some exemplary embodiments, the update period is a time interval to re-generate the local object information by the electronic device.

In some exemplary embodiments, the electronic device is a vehicle device.

In some exemplary embodiments, the electronic device is a road side unit (RSU), and the method further comprises broadcasting the object integration information.

In some exemplary embodiments, the node is a road side unit (RSU) or a vehicle device.

In an exemplary embodiment, a device for sensing a traffic environment is provided. The device comprises one or more processors and one or more computer storage media for storing one or more computer-readable instructions. The processor is configured to drive the computer storage media to execute the following tasks: generating local object information by sensing an environment within a first sensing range of the device, wherein the local object information at least includes first geographical distribution information of local objects within the first sensing range; receiving external object information transmitted by at least one node, wherein the external object information includes at least second geographical distribution information of external objects within a second sensing range of the node; and generating object integration information according to the local object information and the external object information.

BRIEF DESCRIPTION OF DRAWINGS

The accompanying drawings are included to provide a further understanding of the disclosure, and are incorporated in and constitute a part of the present disclosure. The drawings illustrate implementations of the disclosure and, together with the description, serve to explain the principles of the disclosure. It should be appreciated that the drawings are not necessarily to scale as some components may be shown out of proportion to the size in actual implementation in order to clearly illustrate the concept of the present disclosure.

DETAILED DESCRIPTION

Various aspects of the disclosure are described more fully below with reference to the accompanying drawings. This disclosure may, however, be embodied in many different forms and should not be construed as limited to any specific structure or function presented throughout this disclosure. Rather, these aspects are provided so that this disclosure will be thorough and complete, and will fully convey the scope of the disclosure to those skilled in the art. Based on the teachings herein one skilled in the art should appreciate that the scope of the disclosure is intended to cover any aspect of the disclosure disclosed herein, whether implemented independently of or combined with any other aspect of the disclosure. For example, an apparatus may be implemented or a method may be practiced using number of the aspects set forth herein. In addition, the scope of the disclosure is intended to cover such an apparatus or method which is practiced using other structure, functionality, or structure and functionality in addition to or other than the various aspects of the disclosure set forth herein. It should be understood that any aspect of the disclosure disclosed herein may be embodied by one or more elements of a claim.

The word "exemplary" is used herein to mean "serving as an example, instance, or illustration." Any aspect described herein as "exemplary" is not necessarily to be construed as preferred or advantageous over other aspects. Furthermore, like numerals refer to like elements throughout the several views, and the articles "a" and "the" includes plural references, unless otherwise specified in the description.

It should be understood that when an element is referred to as being "connected" or "coupled" to another element, it may be directly connected or coupled to the other element or intervening elements may be present. In contrast, when an element is referred to as being "directly connected" or "directly coupled" to another element, there are no intervening elements present. Other words used to describe the relationship between elements should be interpreted in a like fashion. (e.g., "between" versus "directly between", "adjacent" versus "directly adjacent", etc.).

Figure 1A:
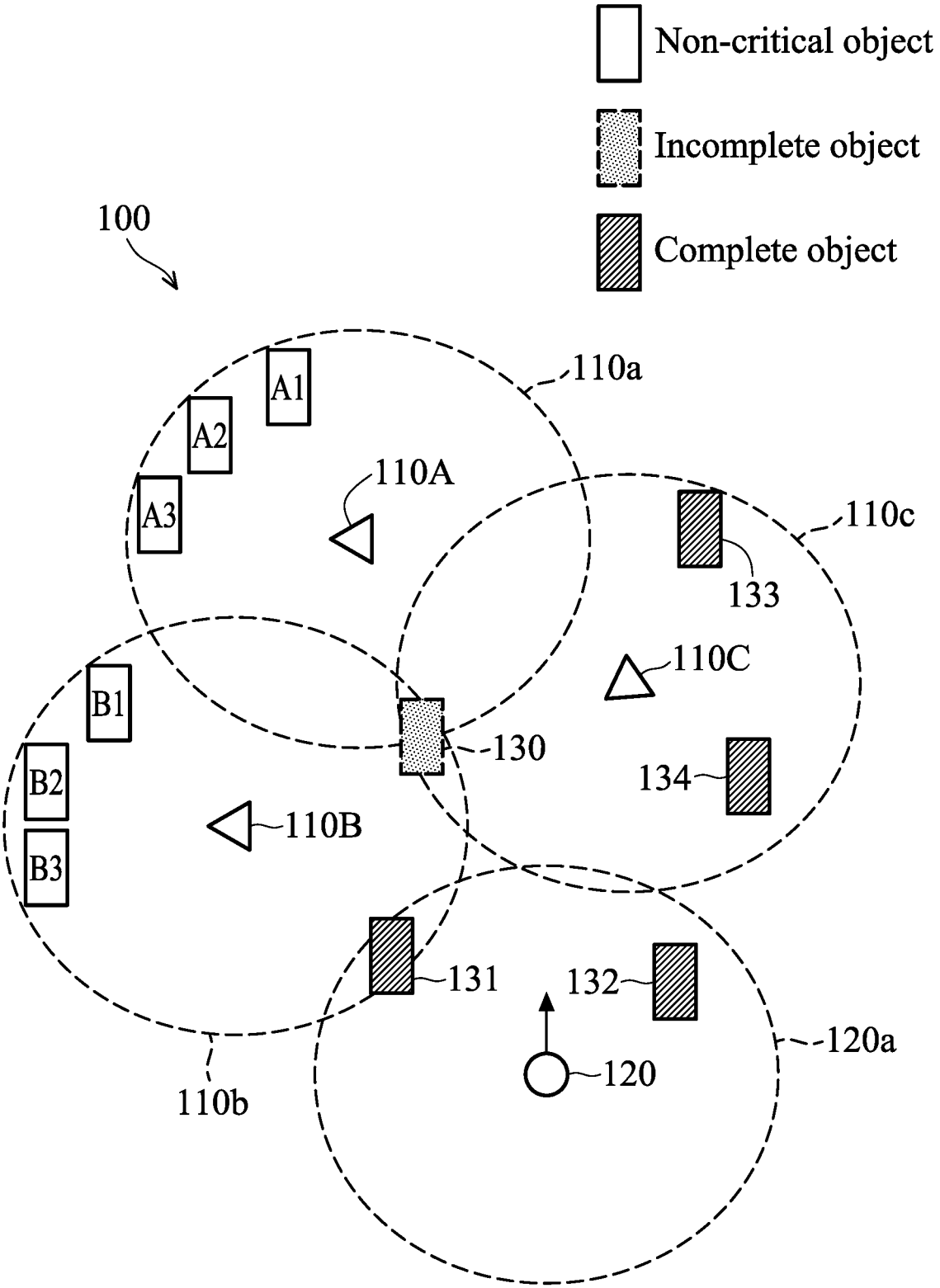
FIGS. 1A~1B are schematic diagrams illustrating a system of sensing the traffic environment according to an exemplary embodiment of the present disclosure.
Figure 1B:
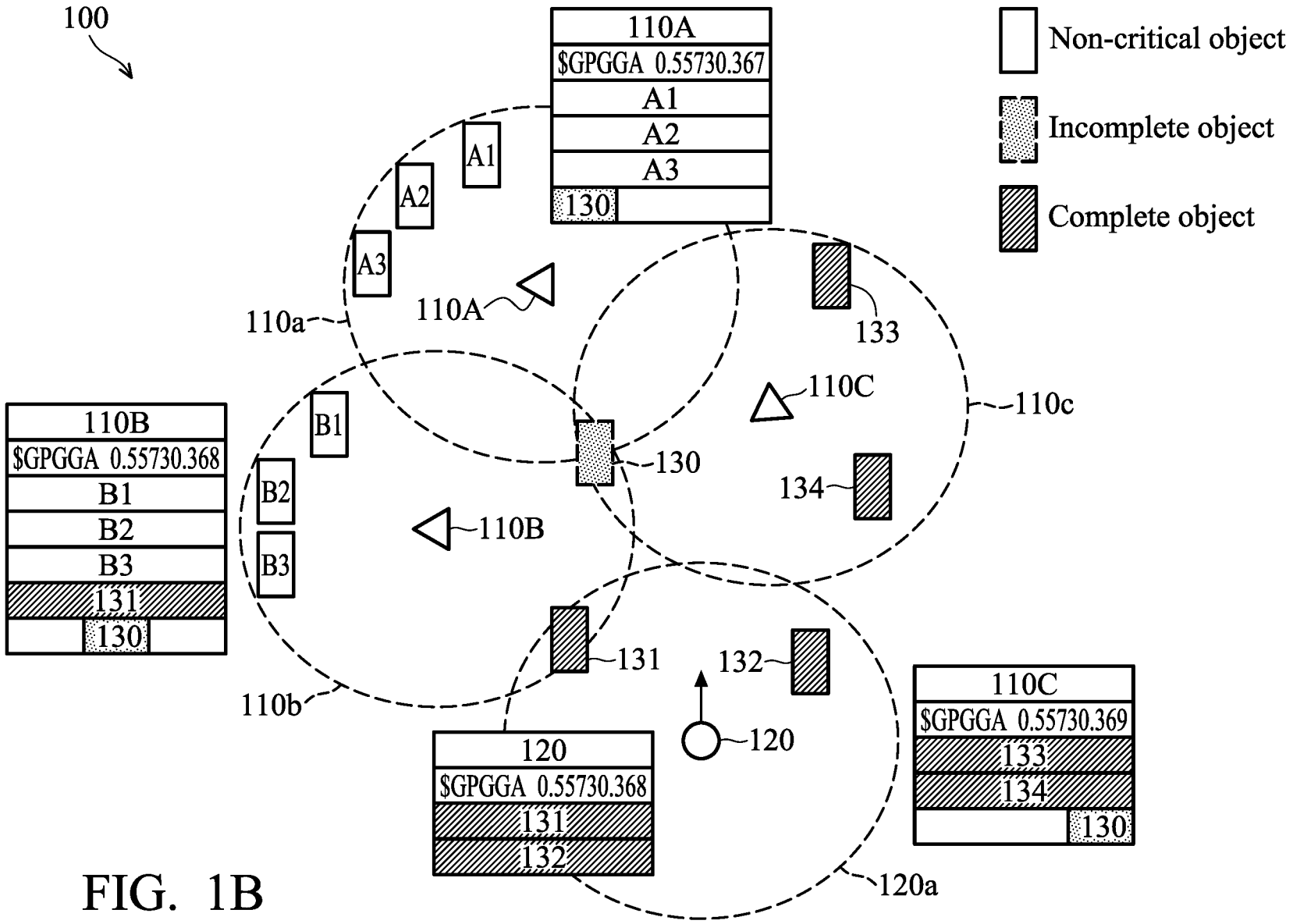

FIGS. 1A~1B are schematic diagrams illustrating a system 100 of sensing the traffic environment according to an exemplary embodiment of the present disclosure. In detail, the system 100 of sensing the traffic environment is a system based on Vehicle-to-Roadside (V2R) communication. As shown in FIG. 1A, the system 100 of sensing the traffic environment may comprise at least one road side units (RSUs) 100A, 110B, 110C and a vehicle device 120. The RSUs 100A, 110B and 110C are disposed at a fixed position, such as an intersection or a road edge, for communicating with one or more vehicle devices 120 having mobile capabilities and communicating with each other. For example, in some exemplary embodiments, the RSUs 100A, 110B and 110C may form a V2R communication network with the vehicle device 120 to communicate with each other. The vehicle device 120 may be a vehicle driving on the road, wherein the vehicle is equipped with an on board unit (OBU) or has a communication capability.

Each of the RSUs 100A, 110B and 110C can periodically sense an environment within a specific sensing range of each of the RSUs by a sensor (for example, a camera, a radar, or a light sensor) to generate local object information, and the vehicle device 120 can also periodically sense an environment within a specific sensing range of the vehicle device 120 by using a sensor (for example, a camera, a radar, or a light sensor) to generate local object information, as shown in FIG. 1B.

Taking the RSU 110A as an example, the RSU 110A can sense the environment within the first sensing range 110*a* of the RSU 110A and generate first local object information, wherein the first local object information comprises an identifier of the RSU 110A and absolute position data, a local time stamp, and first geographical distribution information of the local objects A1, A2, A3 and 130 within the first sensing range 110*a*. The local timestamp is the time at which the first local object information is generated. As shown in FIG. 1B, the local time stamp of the RSU 110A is $GPGGA 055730.367. The first geographical distribution information comprises relative location data of the local objects A1, A2, A3 and 130 relative to the RSU 110A. In addition, the first local object information may further comprise 3D information of all the sensed objects (including non-critical, incomplete, complete objects). For example, each object is a rectangular parallelepiped, and the rectangular parallelepiped has 8 vertices, such as P1, P2, . . . , P8. The 3D information of each object is composed of the three-dimensional coordinates of the eight vertices (P1, P2, . . . , P8). Since the object 130 is an incomplete object for the RSU 110A, the object 130 is only partially presented in the first local object information, as shown in FIG. 1B.

Taking the RSU 110B as an example, the RSU 110B can sense the environment within the second sensing range 110*b* of the RSU 110B and generate second local object information, wherein the second local object information comprises an identifier of the RSU 110B and absolute position data, a local time stamp, and second geographical distribution information of the local objects B1, B2, B3 and 130 within the second sensing range 110*b*. The local timestamp is the time at which the second local object information is generated. As shown in FIG. 1B, the local time stamp of the RSU 110B is $GPGGA 055730.368. The second geographical distribution information comprises relative location data of the local objects B1, B2, B3 and 130 relative to the RSU 110B. Since the object 130 is an incomplete object for the RSU 110B, the object 130 is only partially presented in the second local object information, as shown in FIG. 1B.

Taking the RSU 110C as an example, the RSU 110C can sense the environment within the third sensing range 110*c* of the RSU 110C and generate third local object information, wherein the third local object information comprises an identifier of the RSU 110C and absolute position data, a local time stamp, and third geographical distribution information of the local objects 130, 133 and 134 within the third sensing range 110*c*. The local timestamp is the time at which the third local object information is generated. As shown in FIG. 1B, the local time stamp of the RSU 110C is $GPGGA 055730.369. The third geographical distribution information comprises relative location data of the local objects 130, 133 and 134 relative to the RSU 110C. Since the object 130 is an incomplete object for the RSU 110C, the object 130 is only partially presented in the third local object information, as shown in FIG. 1B.

Taking the vehicle device 120 as an example, the vehicle device 120 can sense the environment within the fourth sensing range 120*a* of the vehicle device 120 and generate fourth local object information, wherein the fourth local object information comprises an identifier of the vehicle device 120 and absolute position data, a local time stamp, and fourth geographical distribution information of the local objects 131 and 132 within the third sensing range 110*c*. The local timestamp is the time at which the fourth local object information is generated. As shown in FIG. 1B, the local time stamp of the vehicle device 120 is $GPGGA 055730.368. The third geographical distribution information comprises relative location data of the local objects 131 and 132 relative to the vehicle device 120.

When each device (the RSU 110A, 110B, 110C or the vehicle device 120) generates its own local object information, each device broadcasts the local object information. Illustratively, the respective object information generated by each device (the RSU 110A, 110B, 110C or the vehicle device 120) is called the local object information. The object information received by a device from other devices broadcasting the object information is called the external object information. For example, the RSU 110A generates and broadcasts the first local object information. The RSU 110B receives the first local object information broadcasted by the RSU 110A. For the RSU 110B, the first local object information is regarded as the external object information. The object information generated by the RSU 110B is called the local object information.

When a device (one of the RSU 110A, 110B, 110C or the vehicle device 120) receives the external object information broadcasted by other devices, the device can generate object integration information according to the local object information and the external object information, and broadcasts the object integration information. In an exemplary embodiment, the object integration information may further comprise a field, wherein the field records the object integration information is integrated by which device's object information.

In an exemplary embodiment, the vehicle device may broadcast the traveling direction of the vehicle device. After the RSU receives the traveling direction, the RSU may determine whether the local object is located in a free space along the traveling direction of the vehicle device. When a part of the local object is not located within the free space, the RSU may mark the object not located within the free space as a non-critical object. For example, as shown in FIGS. 1A~1B, the RSU 110A can mark the local objects A1, A2 and A3 as non-critical objects. When a part of the local object is located within the free space, the RSU may mark the object within the free space as a complete object or an incomplete object. For example, as shown in FIGS. 1A~1B, the RSU 110C may mark the local object 130 as an incomplete object and mark the local object 133 and 134 as complete objects.

It should be understood that the RSUs 110A, 110B, 110C and the vehicle device 120 shown in FIGS. 1A~1B is an example of one suitable system 100 architecture sensing the traffic environment. Each of the components shown in FIGS. 1A~1B may be implemented via any type of electronic device, such as the electronic device 500 described with reference to FIG. 5, for example.

Figure 2:
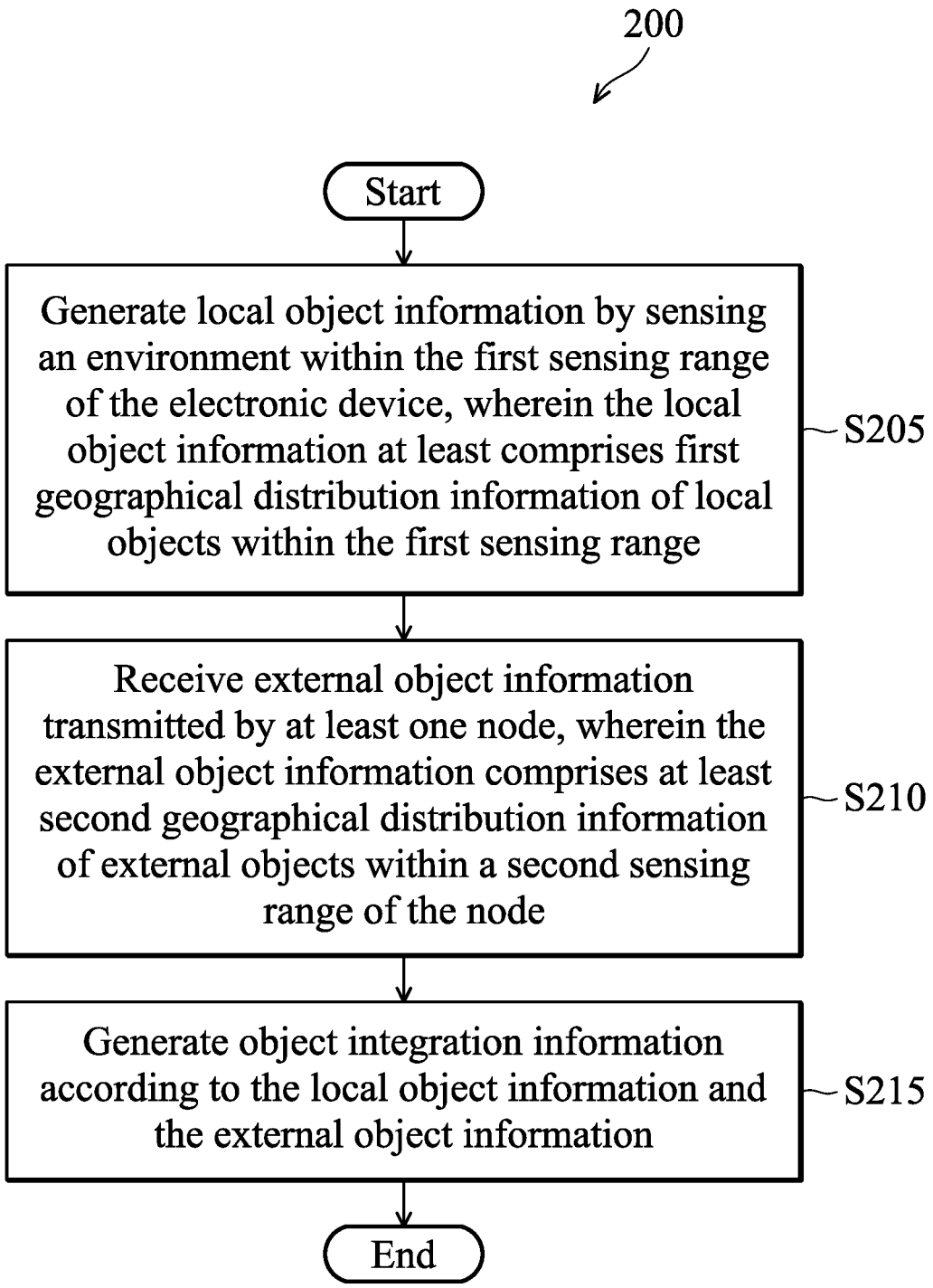
FIG. 2 is a flowchart illustrating a method for sensing the traffic environment according to an exemplary embodiment of the present disclosure.

FIG. 2 is a flowchart illustrating a method 200 for sensing the traffic environment according to an exemplary embodiment of the present disclosure. The method can be implemented in an electronic device (one of the RSUs 110A, 110B, 110C and the vehicle device 120) in the system 100 of sensing the traffic environment as shown in FIGS. 1A-1B.

In step S205, the electronic device generates local object information by sensing an environment within the first sensing range of the electronic device, wherein the local object information at least comprises first geographical distribution information of local objects within the first sensing range. In an exemplary embodiment, the local object information further comprises an identifier of the electronic device, first absolute position data of the electronic device and a local timestamp, and the first geographical distribution information comprises relative position data of the local objects relative to the electronic device.

Next, in step S210, the electronic device receives external object information transmitted by at least one node, wherein the external object information comprises at least second geographical distribution information of external objects within a second sensing range of the node. In an exemplary embodiment, the external object information further comprises an identifier of the node, second absolute position data of the node and an external time stamp, and the second position distribution information comprises relative position data of the external objects relative to the node.

In step S215, the electronic device generates object integration information according to the local object information and the external object information. In an exemplary embodiment, the electronic device and the node are a RSU or a vehicle device. In another exemplary embodiment, when the electronic device is a RSU, the electronic device further broadcasts the object integration information after the step S215 is performed.

Figure 3:
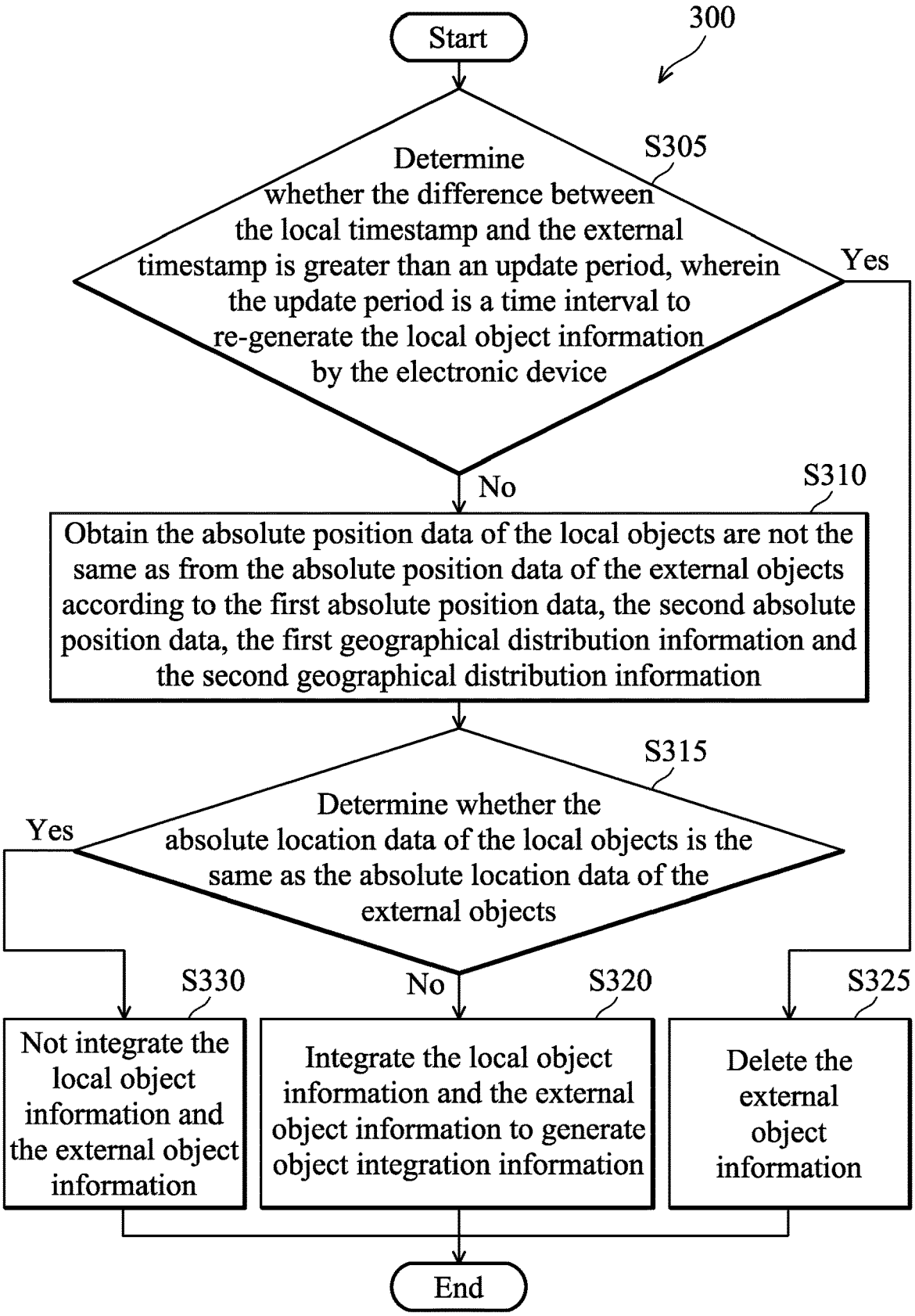
FIG. 3 is a flowchart of a method illustrating that the electronic device generates the object integration information according to the local object information and the external object information in accordance with an exemplary embodiment of the present disclosure.

The following may explain in detail how the electronic device generates the object integration information according to the local object information and the external object information in step S215. FIG. 3 is a flowchart of a method 300 illustrating that the electronic device generates the object integration information according to the local object information and the external object information in accordance with an exemplary embodiment of the present disclosure.

In step S305, the electronic device determines whether the difference between the local timestamp and the external timestamp is greater than an update period, wherein the update period is a time interval to re-generate the local object information by the electronic device. When the difference is not greater than the update period ("No" in step S305), in step S310, the electronic device obtains the absolute position data of the local objects are not the same as the absolute position data of the external objects according to the first absolute position data, the second absolute position data, the first geographical distribution information and the second geographical distribution information. Specifically, the electronic device may unify the coordinate systems between the electronic device and the node by using the Real Time Kinematics (RTK) of the carrier phase information of the GPS signal to obtain the absolute position data of the local objects and the absolute position data of the external objects.

Next, in step S315, the electronic device determines whether the absolute location data of the local objects is the same as the absolute location data of the external objects. In an exemplary embodiment, when the distance between the center of the position of the local object and the center of the position of the external object is less than a first predetermined value (e.g., 0.5 meters) and the height difference between the height of the local object and the height of the external object is less than a second predetermined value (e.g., 0.1 meters), the electronic device determines that the absolute position data of the local object is the same as the absolute position data of the external object. In other words, the electronic device determines that the local object and the external object are the same object. In another exemplary embodiment, the electronic device may also use a 3D algorithm to determine whether the absolute location data of the local object is the same as the absolute location data of the external object. Exemplary 3D algorithms can use surface vertex features to determine whether the seams between the local object and the external object are smooth, compare the local object and the external object by suing the features of distribution histogram, project the data of the local object and the external object into a 2D plane, obtains a shell to determine whether the seams are reasonable by using a convex hull, learn by neural networks, and determine whether the local object and the external object belong to the same group by using clustering to determine whether the local object and the external object are the same object.

When the electronic device determines that the absolute location data of the local object is not the same as the absolute location data of the external object ("No" in step S315), in step S320, the electronic device integrates the local object information and the external object information to generate object integration information. Specifically, the electronic device stitches the local object information and the external object information to generate the object integration information, wherein the object integration information is final information generated by combining the scenes sensed by the electronic device and the node, wherein the final information is a wide range of final image.

Returning to step S305, when the difference is greater than the update period ("Yes" in step S305), in step S325, the electronic device deletes the external object information. In other words, the external object information may not conform to the current situation, and therefore the electronic device does not use the external object information.

Returning to step S315, when the electronic device determines that the absolute position data of the local object is the same as the absolute position data of the external object ("Yes" in step S315), in step S330, the electronic device does not integrate the local object information and the external object information. In other words, the external object information sensed by the node may be the same as the local object information sensed by the electronic device, and therefore the electronic device does nothing.

Figure 4A:
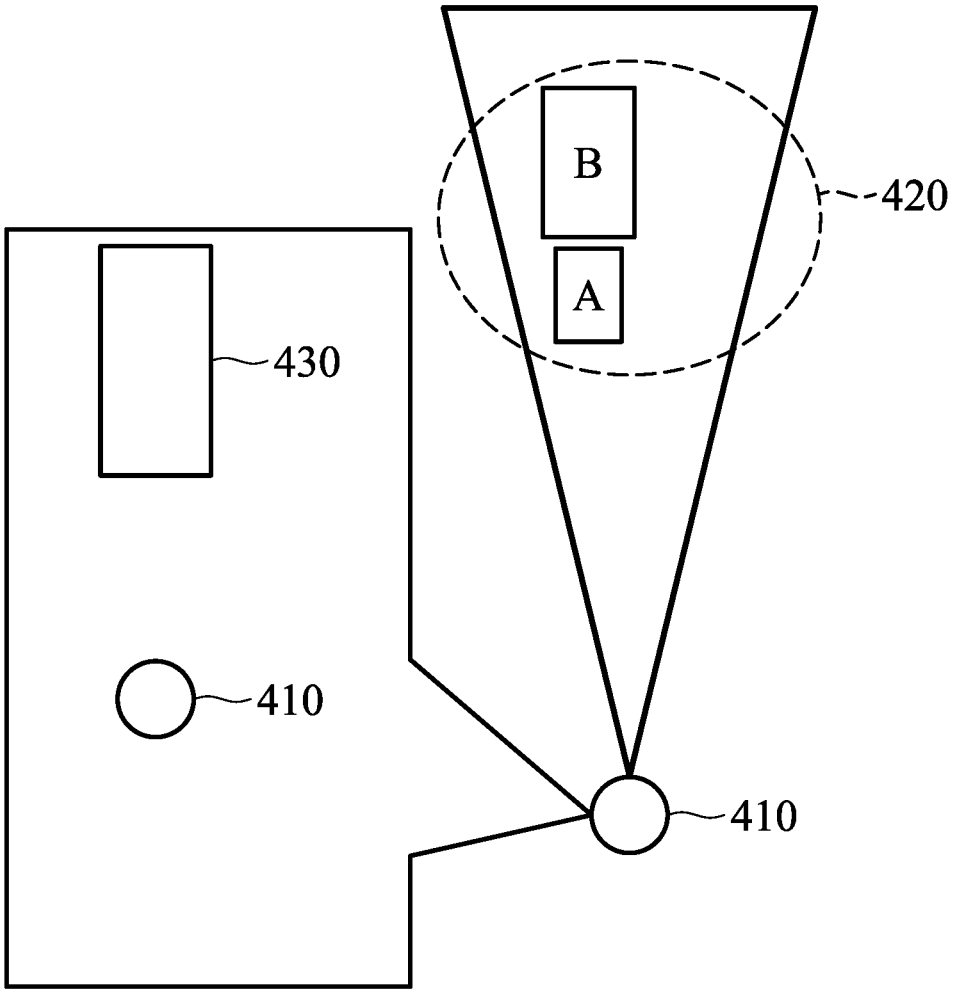
FIG. 4A is a schematic diagram illustrating the vehicle device sensing an object according to an exemplary embodiment of the present disclosure.
Figure 4B:
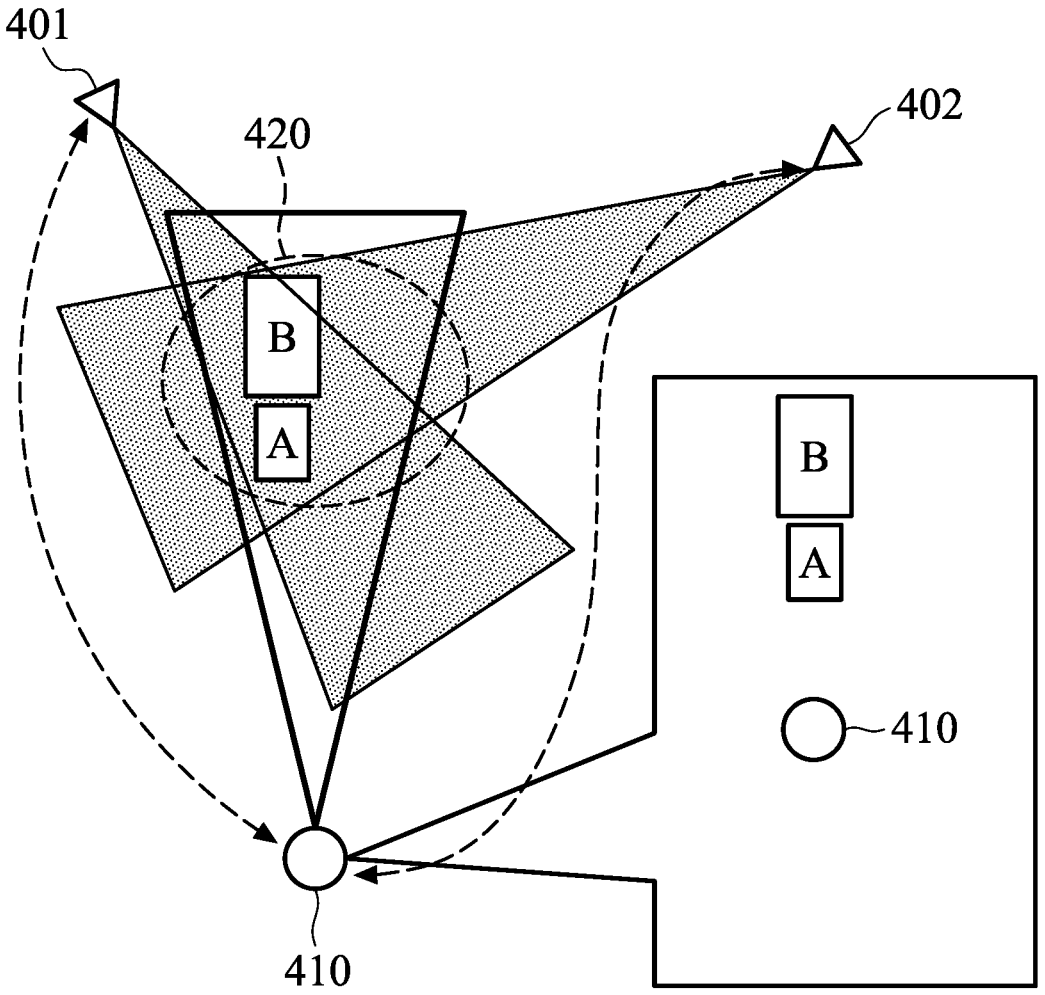
FIG. 4B is a schematic diagram illustrating that the vehicle device using the object integration information senses the objects according to an exemplary embodiment of the present disclosure.

FIG. 4A is a schematic diagram illustrating the vehicle device 410 sensing an object. As shown in FIG. 4A, since the camera or radar mounted on the vehicle device 410 may monitor the area 420 only from a certain direction, the vehicle device 410 may easily regard the object A and the object B as the same object 430. FIG. 4B is a schematic diagram illustrating that the vehicle device 410 using the object integration information senses the objects according to an exemplary embodiment of the present disclosure. As shown in FIG. 4B, through the object integration information broadcasted by the RSU 401 and the RSU 402, the vehicle device 410 may monitor the area 420 from different directions according to the object integration information to distinguish the object A from the object B.

As described above, through the method and the device for sensing the traffic environment provided in the disclosure, the vehicle device can obtain the blind spots in multiple directions by obtaining the object integration information stitched by the RSUs to improve the driving safety of the vehicle.

Figure 5:
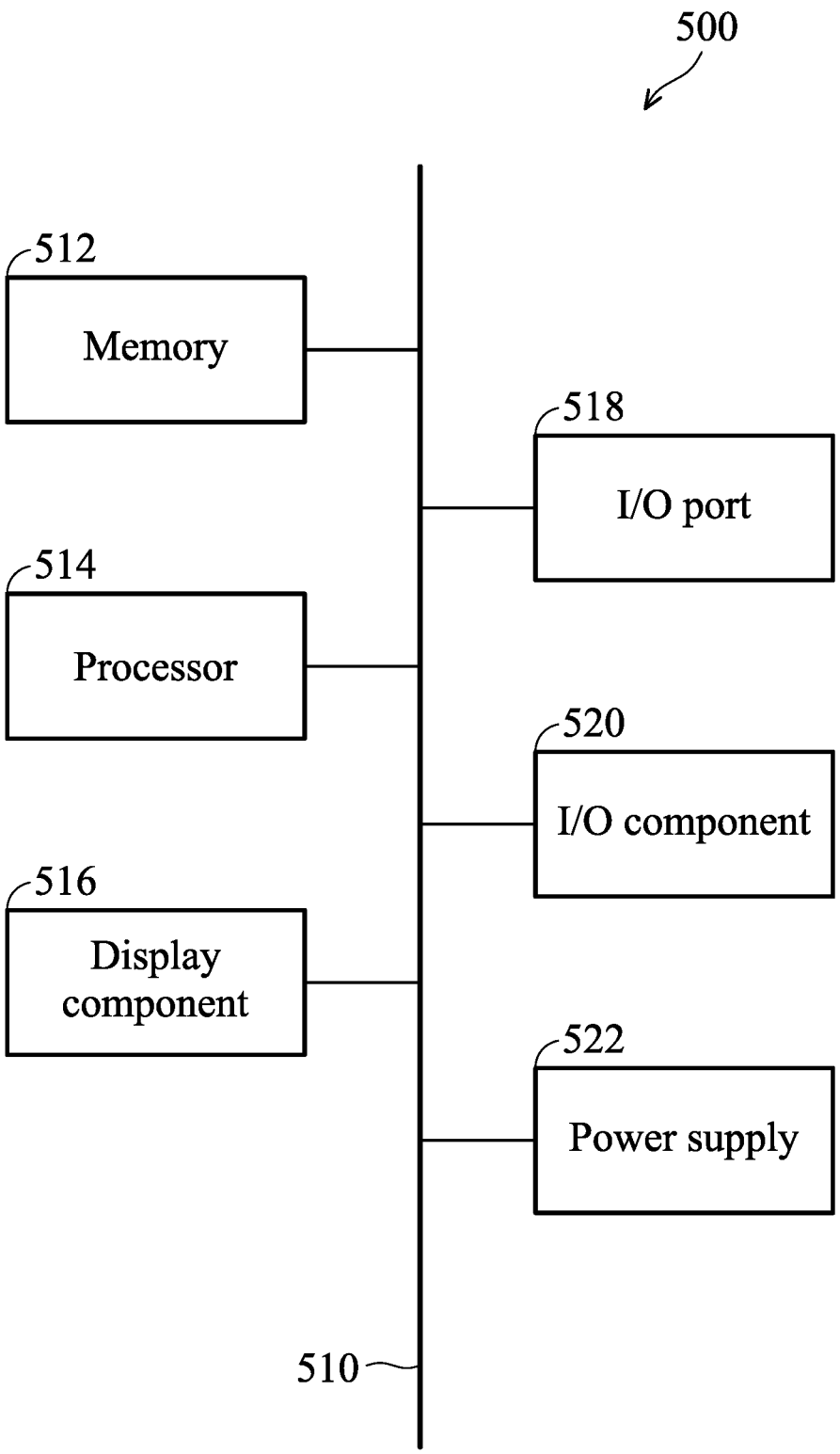
FIG. 5 illustrates an exemplary operating environment for implementing exemplary embodiments of the present disclosure.

Having described exemplary embodiments of the present disclosure, an exemplary operating environment in which exemplary embodiments of the present disclosure may be implemented is described below. Referring to FIG. 5, an exemplary operating environment for implementing exemplary embodiments of the present disclosure is shown and generally known as an electronic device 500. The electronic device 500 is merely an example of a suitable computing environment and is not intended to limit the scope of use or functionality of the disclosure. Neither should the electronic device 500 be interpreted as having any dependency or requirement relating to any one or combination of components illustrated.

The disclosure may be realized by means of the computer code or machine-useable instructions, including computer-executable instructions such as program modules, being executed by a computer or other machine, such as a personal data assistant (PDA) or other handheld device. Generally, program modules may include routines, programs, objects, components, data structures, etc., and refer to code that performs particular tasks or implements particular abstract data types. The disclosure may be implemented in a variety of system configurations, including hand-held devices, consumer electronics, general-purpose computers, more specialty computing devices, etc. The disclosure may also be implemented in distributed computing environments where tasks are performed by remote-processing devices that are linked by a communication network.

With reference to FIG. 5, the electronic device 500 may include a bus 510 that is directly or indirectly coupled to the following devices: one or more memories 512, one or more processors 514, one or more display components 516, one or more input/output (I/O) ports 518, one or more input/output components 520, and an illustrative power supply 522. The bus 510 may represent one or more kinds of busses (such as an address bus, data bus, or any combination thereof). Although the various blocks of FIG. 5 are shown with lines for the sake of clarity, and in reality, the boundaries of the various components are not specific. For example, the display component such as a display device may be considered an I/O component and the processor may include a memory.

The electronic device 500 typically includes a variety of computer-readable media. The computer-readable media can be any available media that can be accessed by electronic device 500 and includes both volatile and nonvolatile media, removable and non-removable media. By way of example, but not limitation, computer-readable media may comprise computer storage media and communication media. The computer storage media may include volatile and nonvolatile, removable and non-removable media implemented in any method or technology for storage of information such as computer-readable instructions, data structures, program modules or other data. The computer storage media may include, but not limit to, random access memory (RAM), read-only memory (ROM), electrically-erasable programmable read-only memory (EEPROM), flash memory or other memory technology, compact disc read-only memory (CD-ROM), digital versatile disks (DVD) or other optical disk storage, magnetic cassettes, magnetic tape, magnetic disk storage or other magnetic storage devices, or any other medium which can be used to store the desired information and which can be accessed by the electronic device 500. The computer storage media may not comprise signal per se.

The communication media typically embodies computer-readable instructions, data structures, program modules or other data in a modulated data signal such as a carrier wave or other transport mechanism and includes any information delivery media. The term "modulated data signal" means a signal that has one or more of its characteristics set or changed in such a manner as to encode information in the signal. By way of example, but not limitation, communication media includes wired media such as a wired network or direct-wired connection, and wireless media such as acoustic, RF, infrared and other wireless media or any combination thereof.

The memory 512 may include computer-storage media in the form of volatile and/or nonvolatile memory. The memory may be removable, non-removable, or a combination thereof. Exemplary hardware devices include solid-state memory, hard drives, optical-disc drives, etc. The electronic device 500 includes one or more processors that read data from various entities such as the memory 512 or the I/O components 520. The presentation component(s) 516 present data indications to a user or other device. Exemplary presentation components include a display device, speaker, printing component, vibrating component, etc.

The I/O ports 518 allow the electronic device 500 to be logically coupled to other devices including the I/O components 520, some of which may be embedded. Illustrative components include a microphone, joystick, game pad, satellite dish, scanner, printer, wireless device, etc. The I/O components 520 may provide a natural user interface (NUI) that processes gestures, voice, or other physiological inputs generated by a user. For example, inputs may be transmitted to an appropriate network element for further processing. The electronic device 500 may be equipped with depth cameras, such as stereoscopic camera systems, infrared camera systems, RGB camera systems, any combination of thereof to realize object detection and recognition. In addition, the electronic device 500 may be equipped with a sensor (e.g., radar or LIDAR) to periodically sense the neighboring environment within a sensing range, and generating sensor information indicating that the electronic device itself being associated with the surrounding environment. Furthermore, the electronic device 500 may be equipped with accelerometers or gyroscopes that enable detection of motion. The output of the accelerometers or gyroscopes may be provided to the display of the electronic device 500 to display.

Furthermore, the processor 514 in the electronic device 500 can execute the program code in the memory 512 to perform the above-described actions and steps or other descriptions herein.

It should be understood that any specific order or hierarchy of steps in any disclosed process is an example of a sample approach. Based upon design preferences, it should be understood that the specific order or hierarchy of steps in the processes may be rearranged while remaining within the scope of the present disclosure. The accompanying method claims present elements of the various steps in a sample order, and are not meant to be limited to the specific order or hierarchy presented.

Use of ordinal terms such as "first," "second," "third," etc., in the claims to modify a claim element does not by itself connote any priority, precedence, or order of one claim element over another or the temporal order in which acts of a method are performed, but are used merely as labels to distinguish one claim element having a certain name from another element having the same name (but for use of the ordinal term) to distinguish the claim elements.

While the disclosure has been described by way of example and in terms of the exemplary embodiments, it should be understood that the disclosure is not limited to the disclosed exemplary embodiments. On the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. A method for sensing a traffic environment, used in an electronic device, comprising:

generating, by a sensor of the electronic device, local object information by sensing an environment within a first sensing range of the electronic device, wherein the local object information at least comprises first geographical distribution information of local objects within the first sensing range, wherein the first sensing range is a range centered on the electronic device;

receiving external object information transmitted by at least one node, wherein the external object information comprises at least second geographical distribution information of external objects within a second sensing range of the node; and generating object integration information according to the local object information and the external object information, wherein the local object information comprises first absolute position data of the electronic device, and the external object information comprises second absolute position data of the node, wherein the step of generating object integration information according to the local object information and the external object information comprises:

obtaining absolute position data of the local objects and absolute position data of the external objects according to the first absolute position data, the second absolute position data, the first geographical distribution information and the second geographical distribution information;

determining whether the absolute position data of the local objects are the same as the absolute position data of the external objects; and integrating the local object information and the external object information to generate object integration information when the absolute position data of the local objects are not the same as the absolute position data of the external object.

2. The method for sensing a traffic environment as claimed in claim 1, wherein the local object information further comprises an identifier of the electronic device, and the external object information further comprises an identifier of the node.

3. The method for sensing a traffic environment as claimed in claim 2, wherein the first geographical distribution information comprises relative position data of the local objects relative to the electronic device, and the second geographical distribution information comprises relative position data of the external objects relative to the node.

4. The method for sensing a traffic environment as claimed in claim 1, wherein the local object information further comprises a local time stamp, and the external object information further comprises an external time stamp.

5. The method for sensing a traffic environment as claimed in claim 4, wherein the step of generating object integration information according to the local object information and the external object information comprises:

determining whether a difference between the local timestamp and the external timestamp is greater than an update period; and deleting the external object information when the difference is greater than the update period.

6. The method for sensing a traffic environment as claimed in claim 5, wherein the update period is a time interval to re-generate the local object information by the electronic device.

7. The method for sensing a traffic environment as claimed in claim 1, wherein the electronic device is a vehicle device.

8. The method for sensing a traffic environment as claimed in claim 1, wherein the electronic device is a road side unit (RSU), and the method further comprises:

broadcasting the object integration information.

9. The method for sensing a traffic environment as claimed in claim 1, wherein the node is a road side unit (RSU) or a vehicle device.

10. A device for sensing a traffic environment, comprising:

one or more processors; and one or more computer storage media for storing one or more computer-readable instructions, wherein the processor is configured to drive the computer storage media to execute the following tasks:

generating, by a sensor of the device, local object information by sensing an environment within a first sensing range of the device, wherein the local object information at least includes first geographical distribution information of local objects within the first sensing range, wherein the first sensing range is a range centered on the device;

receiving external object information transmitted by at least one node, wherein the external object information includes at least second geographical distribution information of external objects within a second sensing range of the node; and generating object integration information according to the local object information and the external object information, wherein the local object information comprises first absolute position data of the device, and the external object information comprises second absolute position data of the node, wherein generating object integration information according to the local object information and the external object information by the processor comprises:

obtaining absolute position data of the local objects and absolute position data of the external objects according to the first absolute position data, the second absolute position data, the first geographical distribution information and the second geographical distribution information;

determining whether the absolute position data of the local objects are the same as the absolute position data of the external objects; and integrating the local object information and the external object information to generate object integration information when the absolute position data of the local objects are not the same as from the absolute position data of the external object.

11. The device for sensing a traffic environment as claimed in claim 10, wherein the local object information further comprises an identifier of the device, and the external object information further comprises an identifier of the node.

12. The device for sensing a traffic environment as claimed in claim 11, wherein the first geographical distribution information comprises relative position data of the local objects relative to the device, and the second geographical distribution information comprises relative position data of the external objects relative to the node.

13. The device for sensing a traffic environment as claimed in claim 10, wherein the local object information further comprises a local time stamp, and the external object information further comprises an external time stamp.

14. The device for sensing a traffic environment as claimed in claim 13, wherein the step of generating object integration information according to the local object information and the external object information by the processor comprises:

determining whether a difference between the local timestamp and the external timestamp is greater than an update period; and deleting the external object information when the difference is greater than the update period.

15. The device for sensing a traffic environment as claimed in claim 14, wherein the update period is a time interval to re-generate the local object information by the electronic device.

16. The device for sensing a traffic environment as claimed in claim 10, wherein the device is a vehicle device.

17. The device for sensing a traffic environment as claimed in claim 10, wherein the device is a road side unit (RSU), and the processor further executes:

broadcasting the object integration information.

18. The device for sensing a traffic environment as claimed in claim 10, wherein the node is a road side unit (RSU) or a vehicle device.

* * * * *